US012171287B2

(12) United States Patent
Stackhouse

(10) Patent No.: US 12,171,287 B2
(45) Date of Patent: Dec. 24, 2024

(54) SLEEVELESS TRAVEL HOODIE WITH BUILT IN TRAVEL PILLOWS

(71) Applicant: Nicholas L Stackhouse, Lakewood, CO (US)

(72) Inventor: Nicholas L Stackhouse, Lakewood, CO (US)

( * ) Notice: Subject to any disclaimer, the term of this patent is extended or adjusted under 35 U.S.C. 154(b) by 92 days.

(21) Appl. No.: 18/093,635

(22) Filed: Jan. 5, 2023

(65) Prior Publication Data

US 2024/0225141 A1 Jul. 11, 2024

(51) Int. Cl.

| | |
|---|---|
| ***A41D 3/02*** | (2006.01) |
| ***A41D 3/08*** | (2006.01) |
| ***A41D 13/05*** | (2006.01) |
| ***A47G 9/10*** | (2006.01) |

(52) U.S. Cl.

CPC ..... *A41D 3/02* (2013.01); *A41D 3/08* (2013.01); *A41D 13/0512* (2013.01); *A47G 9/1081* (2013.01); *A41D 2200/20* (2013.01)

(58) Field of Classification Search

CPC ..... A41D 3/02; A41D 3/08; A41D 13/0512; A41D 2200/20; A47G 9/1081

See application file for complete search history.

(56) References Cited

U.S. PATENT DOCUMENTS

| | | | | | |
|---|---|---|---|---|---|
| 197,346 | A * | 11/1877 | Denneler | A41D 3/08 | 2/88 |
| 265,536 | A * | 10/1882 | Oberst | A41D 3/02 | 2/202 |
| 1,309,042 | A * | 7/1919 | Milkes | | 2/84 |
| 2,745,104 | A * | 5/1956 | Pompa | A41D 3/08 | 2/88 |
| 4,345,346 | A * | 8/1982 | Holtz | A44B 99/00 | 5/640 |
| 4,422,184 | A * | 12/1983 | Myers | A01K 55/00 | 2/84 |
| 5,095,894 | A * | 3/1992 | Marble | A61F 5/3746 | 602/62 |
| 5,546,604 | A * | 8/1996 | Geller | A42B 1/046 | 2/202 |
| 6,595,936 | B1 * | 7/2003 | Oladipo | A61F 5/3746 | 602/5 |
| 6,966,069 | B2 * | 11/2005 | Booth | A47G 9/066 | 2/48 |
| 7,213,883 | B2 * | 5/2007 | Charnitski | A47C 7/383 | 297/452.41 |
| 8,650,664 | B2 | 2/2014 | Parr | | |
| 9,295,292 | B2 * | 3/2016 | Sachs | A41D 1/002 | |
| 9,439,463 | B1 | 9/2016 | Spears | | |

(Continued)

FOREIGN PATENT DOCUMENTS

| | | |
|---|---|---|
| EP | 1224877 A2 | 1/2002 |
| KR | 101400350 B1 | 4/2014 |

*Primary Examiner* — Khaled Annis

(74) *Attorney, Agent, or Firm* — Michael R. Schacht; Schacht Law Office, Inc.

(57) ABSTRACT

A sleeveless hoodie is described that is characterized by a sleeveless tubular body with an opposing pair of internal elbow pockets, an oversized hood made of a partially-see through mesh fabric that is configured to cover the eyes and at least part of the face, and a pair of separate and distinct neck pillow members located on the top of the tubular body along the left and right sides of a neck opening.

20 Claims, 12 Drawing Sheets

(56) References Cited

U.S. PATENT DOCUMENTS 9,521,873 B1 * 12/2016 Mignone ..... A41D 3/005
9,788,671 B1 * 10/2017 Wuerz ..... A41D 3/08
10,010,193 B2 * 7/2018 Simmer ..... A41C 3/08
10,420,431 B1 * 9/2019 Speciale ..... A41D 31/02
10,499,696 B2 12/2019 Mitchell
10,863,836 B2 12/2020 Schneider
11,304,840 B2 * 4/2022 Trujillo ..... A41B 1/10
11,317,662 B2 * 5/2022 Watts ..... A41D 13/0058
D955,783 S 6/2022 Estorco
11,457,754 B1 10/2022 Adelipour
11,910,857 B1 * 2/2024 Buentello ..... A41D 31/10
2002/0156407 A1 * 10/2002 Estep ..... A61F 5/3746 602/4
2005/0144695 A1 * 7/2005 Aldridge ..... A41D 13/02 2/69
2005/0173962 A1 * 8/2005 Stein ..... B60N 2/7005 297/397
2009/0031473 A1 * 2/2009 Hartfield ..... A41D 3/08 2/87
2012/0005801 A1 * 1/2012 Parr ..... A41D 3/00 2/84
2012/0144550 A1 6/2012 Nejad
2013/0125312 A1 5/2013 Harooni
2014/0157480 A1 * 6/2014 Czarnik ..... A47G 9/064 5/486
2014/0237705 A1 * 8/2014 Cominsky ..... A42B 1/04 2/410
2015/0026863 A1 * 1/2015 Elsmo ..... A47G 9/066 2/84
2015/0143604 A1 * 5/2015 Mizrahi ..... A42B 1/048 2/84
2016/0374415 A1 * 12/2016 Chang ..... A41D 15/00 2/69
2017/0208881 A1 7/2017 Leathers
2018/0020750 A1 * 1/2018 Nam ..... D04B 15/10 2/69
2018/0289183 A1 * 10/2018 Karl ..... A47C 7/383
2018/0317575 A1 * 11/2018 Nam ..... A41D 27/24
2019/0021408 A1 * 1/2019 Mangnall-Schwarz ... A63J 7/00
2019/0059464 A1 2/2019 Hoebee
2019/0167020 A1 * 6/2019 Bice ..... A47C 7/46
2022/0071417 A1 * 3/2022 Baugh ..... A61G 7/072
2022/0400782 A1 * 12/2022 Lindsay ..... A41D 13/001
2023/0389629 A1 * 12/2023 Garneau ..... A41D 13/001
2024/0065350 A1 * 2/2024 Lakota ..... A41D 13/0512

* cited by examiner

SLEEVELESS TRAVEL HOODIE WITH BUILT IN TRAVEL PILLOWS

BACKGROUND

Air travel can be a trying experience for passengers. Seats can be cramped, they do not recline much if at all, they offer very little support, and they are not configured to support sleeping. There is often competition for shared arm rests, and those passengers that lose the arm rest battle have to awkwardly figure out where to place their arms. Adding to the discomfort posed by the seats are the noise and commotion posed by other passengers. Finally, the temperature in the cabin can become uncomfortably chilly especially when the overhead vent cannot be closed as is the case on many commercial aircraft.

To try and improve comfort some passengers are known to use generally u-shaped travel pillows to provide neck support when trying to sleep in an upright position, which help but can push the user's neck too far forward in the seat causing some discomfort. Sleep masks can be used to shield out light and visual commotion, but leave a passenger effectively blind to the goings on in his/her surroundings. A passenger may also have to wear a sweatshirt, hoodie or jacket to provide extra warmth adding another item to an ever growing number of travel aids that must be kept track of and stowed in an ever deceasing amount of personal space.

DETAILED DESCRIPTION

Figure 1:
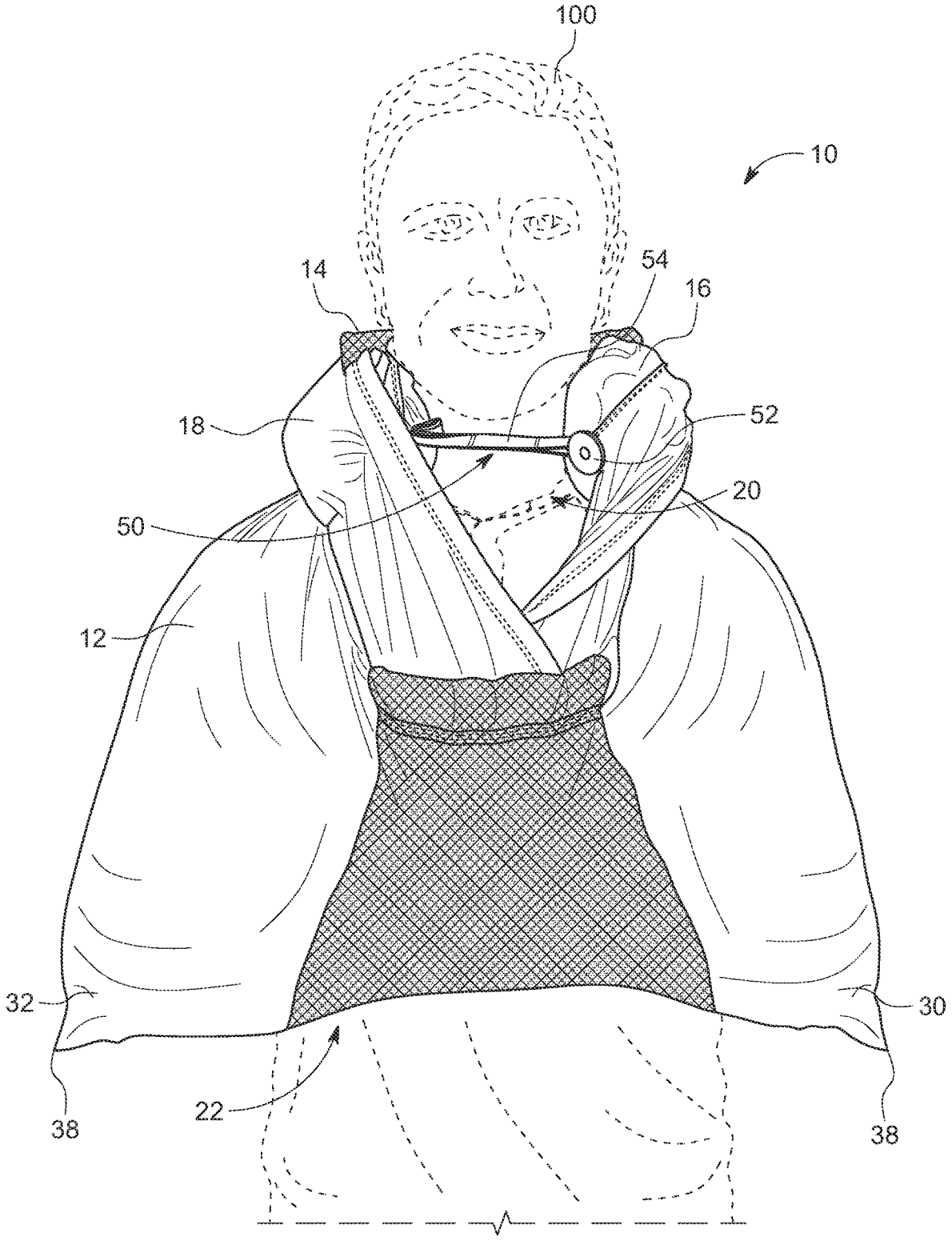
FIG. 1 is a perspective front view of the travel hoodie as being worn by a user with the hood in the down or undeployed position according to an embodiment of the present invention.

Embodiments of a sleeveless hoodie is described comprising (i) a tubular body with an opposing pair of internal elbow pockets, (ii) an oversized hood made of a partially-see through mesh fabric attached to the tubular body proximate a neck opening thereof, and (iii) a pair of separate and distinct neck pillow members located on the top of the tubular body along the left and right sides of a neck opening.

Advantageously, the hoodie when worn during air travel permits a wearer to assume a relatively comfortable and relaxing position despite the challenges posed by commercial airline seating. The wearer's arms can be supported in a folded position in front of the wearer with the wearer's elbows being received in the opposing elbow pockets on the inside of the tubular body. The tubular body also acts to keep the arms and upper body warm and in some variations where the tubular body is comprised of an elastic fabric, the tubular body provides a sense of comforting compression.

By donning the oversized hood, the wearer can shield his or her eyes filtering out a significant amount of light and glare, and preventing others from seeing much if not substantially all of the wear's face while at the same time permitting the wearer to see outwardly. Further, the neck pillow members provide support for the wearer's neck as he or she cocks his/her head to the side to sleep, but because the sections are not connected in the back, the pillow members do not act to push the wearer's neck and head uncomfortably forward as the wearer leans back against the seatback.

The design of the tubular body permits it to be pulled upwardly and positioned about the wearer's neck freeing the wearer's body but still permitting the use of the pillow members and the hood as may be desired. This permits a wearer to leave the garment on his/her person while in a terminal before, after or while transferring between flights.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive, rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, upper, lower, vertical, horizontal, back, front and lateral are relative to each other and are dependent on the specific orientation of an applicable element or article, and are used accordingly to aid in the description of the various embodiments and are not necessarily intended to be construed as limiting.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

The phrase "elastic fabric" as used in this specification and appended claims refers to any fabric that can stretch at least 33% elastically returning to it prior dimensions when a stretching force is relieved. Typically, elastic fabrics comprise a base fiber, such as nylon or polyester, interwoven with 5-15% of a highly elastic fiber, such as spandex.

The phrase "tubular body" as used in this specification and appended claims refers to the substantially fabric portion of the garment having a torso opening at a bottom end and a neck opening at an opposing top end. The tubular body need not be cylindrical and may have comprise additional features, such as elbow pockets, formed therein.

A "kangaroo pocket" refers to a through pocket having opposing left and right openings. Kangaroo pockets are often found on traditional hoodies on the outside of the hoodie's front side although as specified for at least one embodiment herein, the kangaroo pocket can be provided in the interior of the garment's tubular body.

As described herein a "mesh fabric" or "perforated fabric" comprises a fabric material that includes opening or holes distributed on and through the fabric such that a significant portion (typically, but not necessarily, 50% or more) of the light incident on the outside of the fabric passes through to the inside of the fabric unhindered permitting a user to see through the fabric when held in front of his or her eyes. The fabric may be woven to create the openings or the openings can be added thereafter.

An Embodiment of a Sleeveless Hoodie

FIGS. 1-6 illustrate an embodiment of the hoodie 10 as worn by a person or wearer 100 in various configurations. While FIGS. 7-12 illustrate portions or components of the garment. Most simply, the garment comprises three primary sections or portions: the tubular body 12, the oversized hood 14; and the left and right pillow members 16 & 18.

Figure 2:
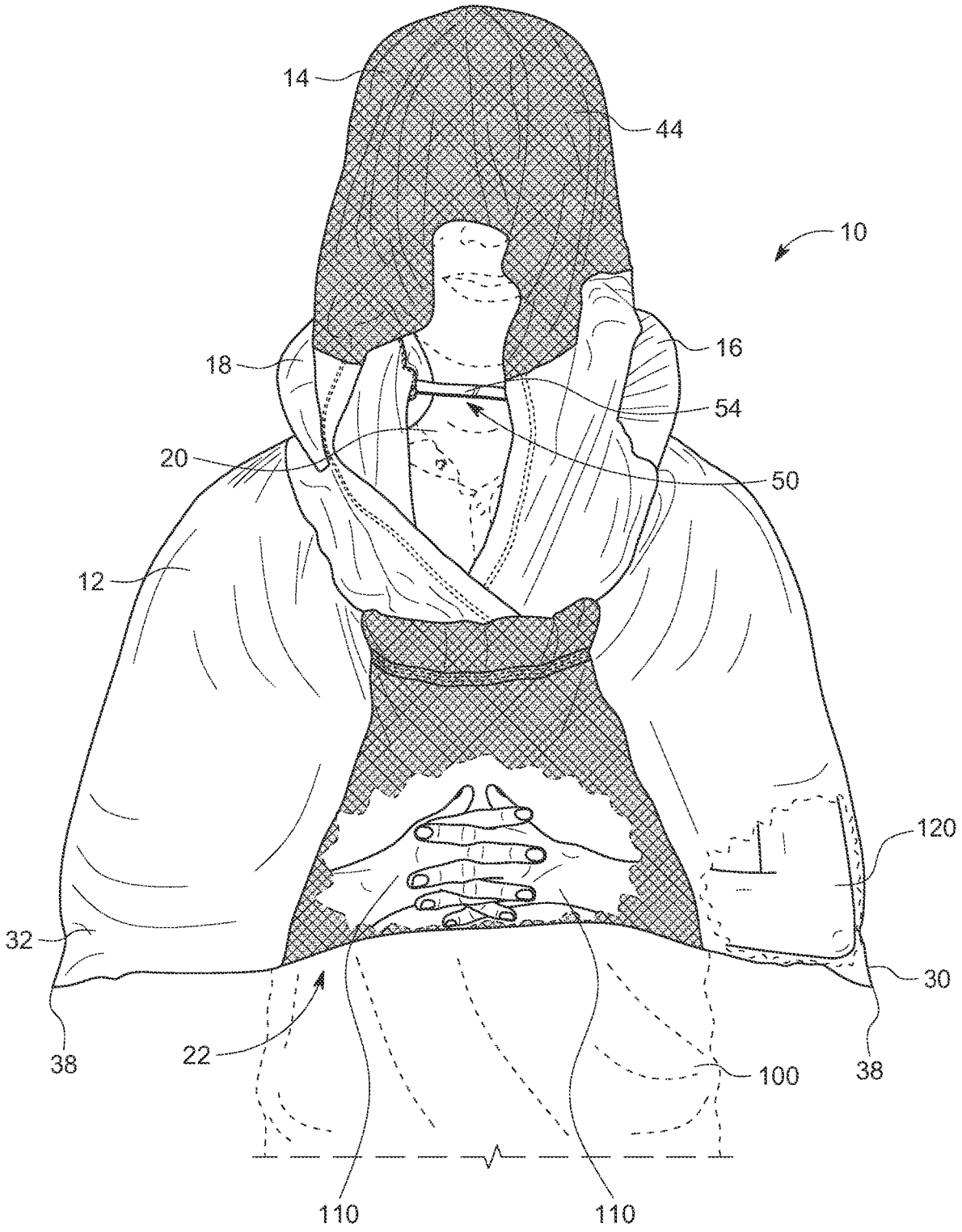
FIG. 2 is a perspective front view of the travel hoodie as being worn by a user with the hood in the up or deployed position wherein two cutaway sections are provided with the front fabric portions removed to illustrate the positions of the users arms and hands according to the embodiment of the present invention.
Figure 3:
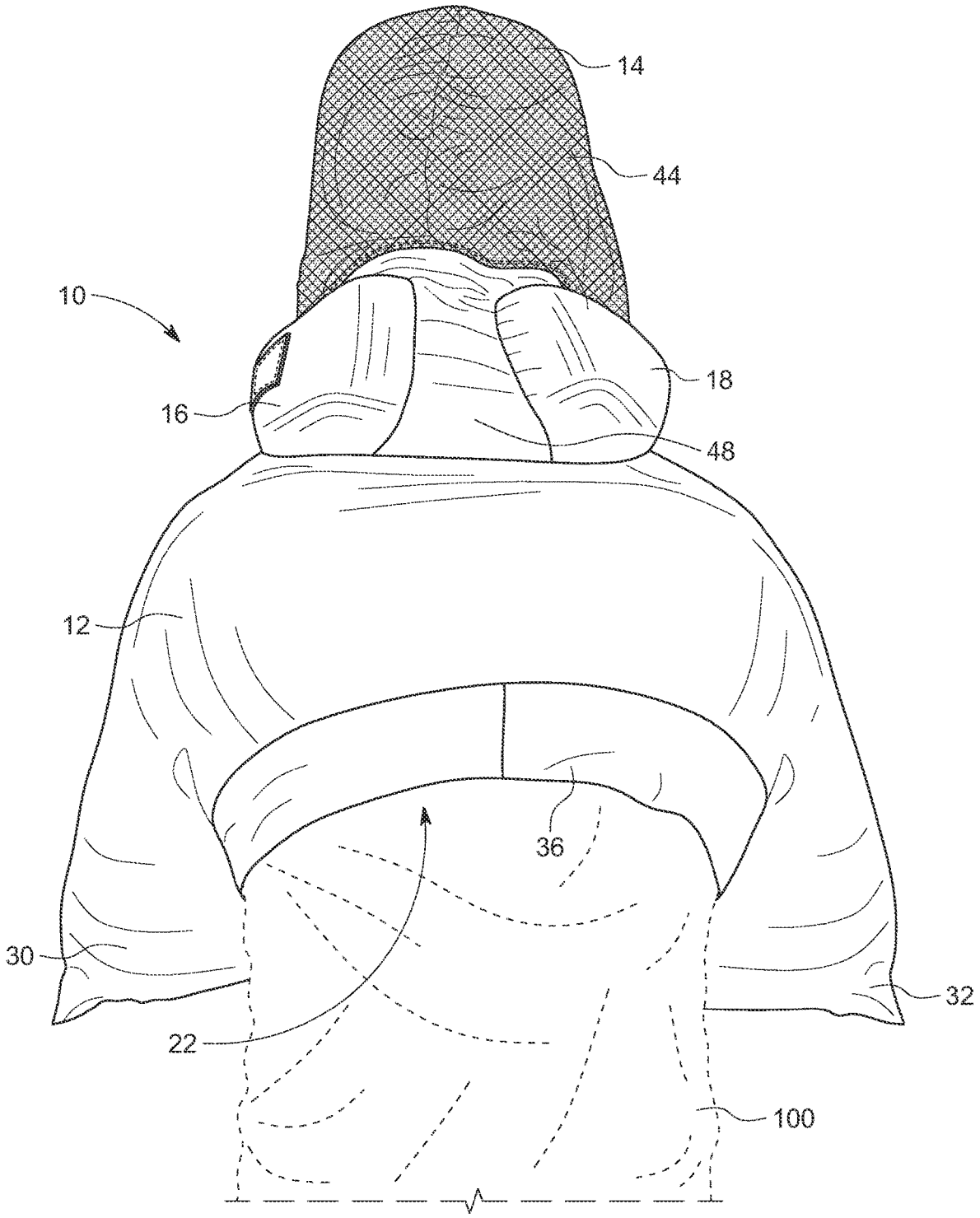
FIG. 3 is a perspective back view of the travel hoodie as being worn by a user with the hood in the deployed position according to the embodiment of the present invention.
Figure 4:
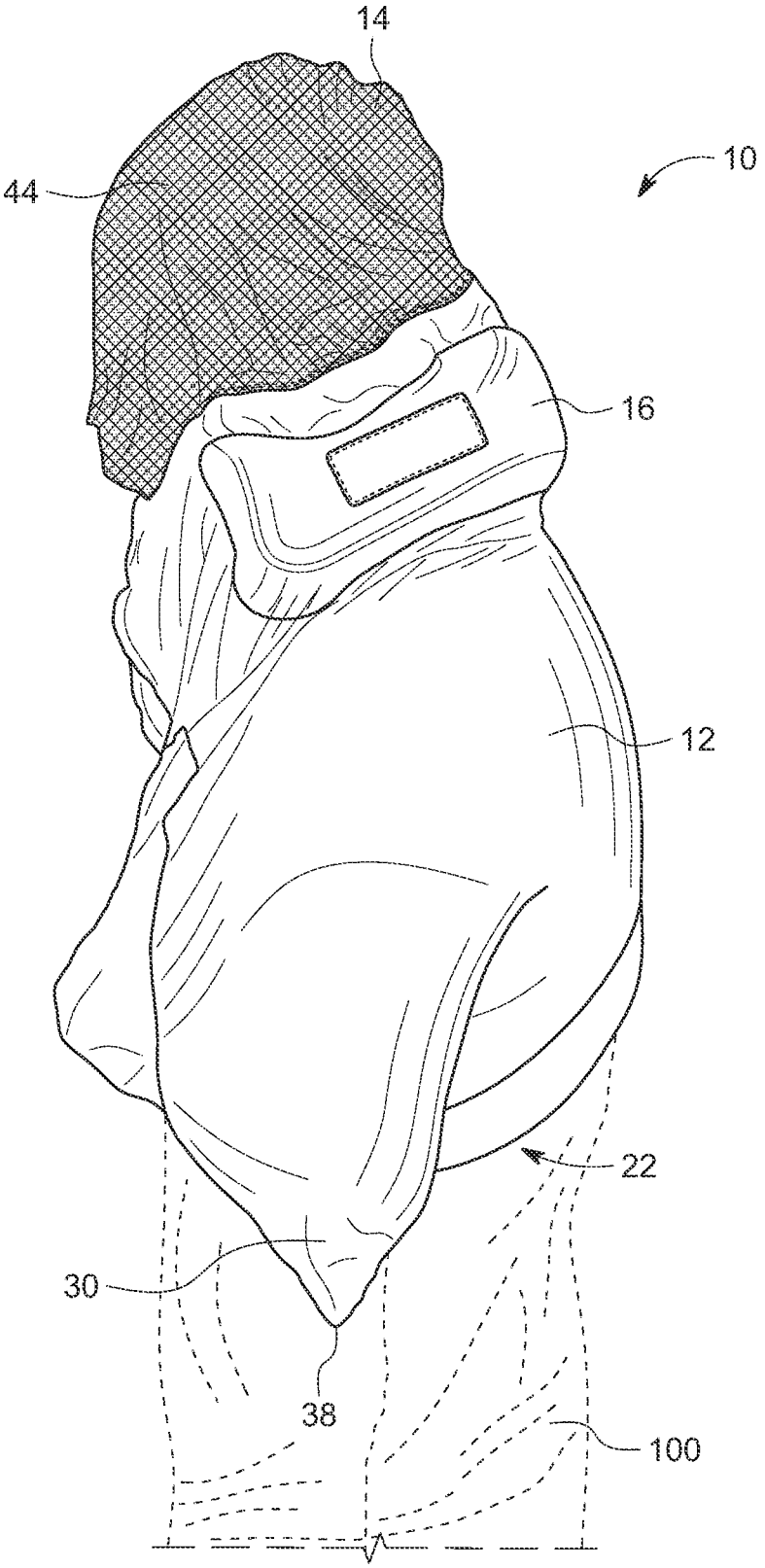
FIG. 4 is a perspective side view of the travel hoodie as being worn by a user with the hood in the deployed position according to the embodiment of the present invention.

The tubular body 12 is tubular in configuration and sleeveless. At a top end it includes an upper neck opening 20, and at a bottom end it has a bottom torso opening 22. The front, side, and back of the tubular body and the garment are shown in FIGS. 2-4 respectively. The tubular body is comprised primarily of a plurality of sections of an elastic fabric that has a soft touch and provides a gentle compression against a wearer's body when worn. In one variation the elastic fabric has a weight of 265 grams per square meter, comprises 88% polyester and 12% spandex, and has an elongation of 83-91% along with being antimicrobial and offering an SPF over 50. Variations comprised of other fabrics are contemplated as well.

Figure 10:
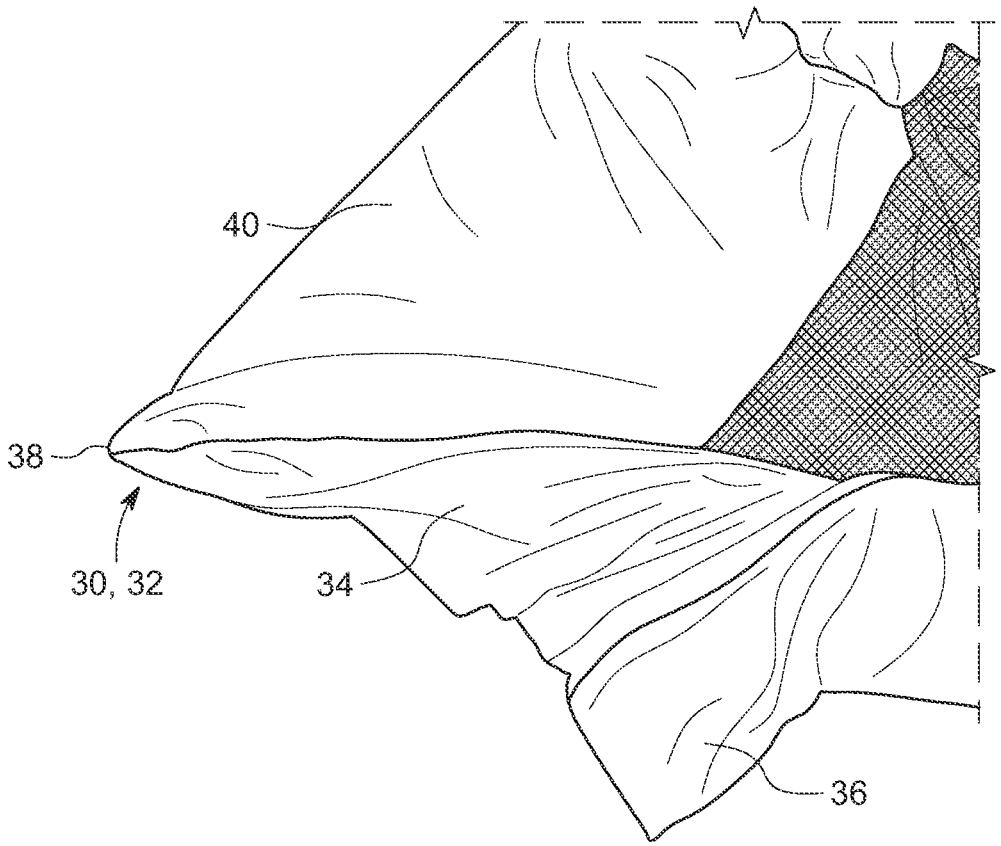
FIG. 10 is a close-up view of an elbow pocket of the tubular body according to the embodiment of the present invention.

The tubular body is characterized by a pair of opposing left and right elbow pockets 30 & 32 that can best be viewed in FIGS. 1-4 shown with a wearer's elbow received therein and in FIG. 10, which shows a closeup of a left elbow pocket. The pockets provide a place to receive and support the elbows 120 of a wearer 100 when he/she crosses his/her arms and/or hands within the tubular body. This can be especially advantageous when wearer does not have access to the arm rest of an airline seat but would nonetheless desire the arm support the armrests provide. FIG. 2 shows two cutaway sections wherein the front pieces of fabric are removed for illustrative purposes showing both the positioning of an elbow in the elbow pocket 30, and the fingers left and right hands 110 intertwined within the interior kangaroo pocket (see FIG. 12).

With reference to FIG. 10 as well as FIG. 1, the elbow pockets 30 & 32 are characterized by a piece of fabric 34 that extends that generally horizontally from the torso hem 36 at the torso opening 22 to a pointed terminus 38 and is joined with the fabric body pieces 40 that extend downwardly from the shoulder and neck opening 20 of the garment. As is best seen in FIG. 1, the torso hem is generally located above wearer's waist generally proximate a location where the wearer's forearms are naturally horizontal when crossed in front of the wearer's body.

Figure 5:
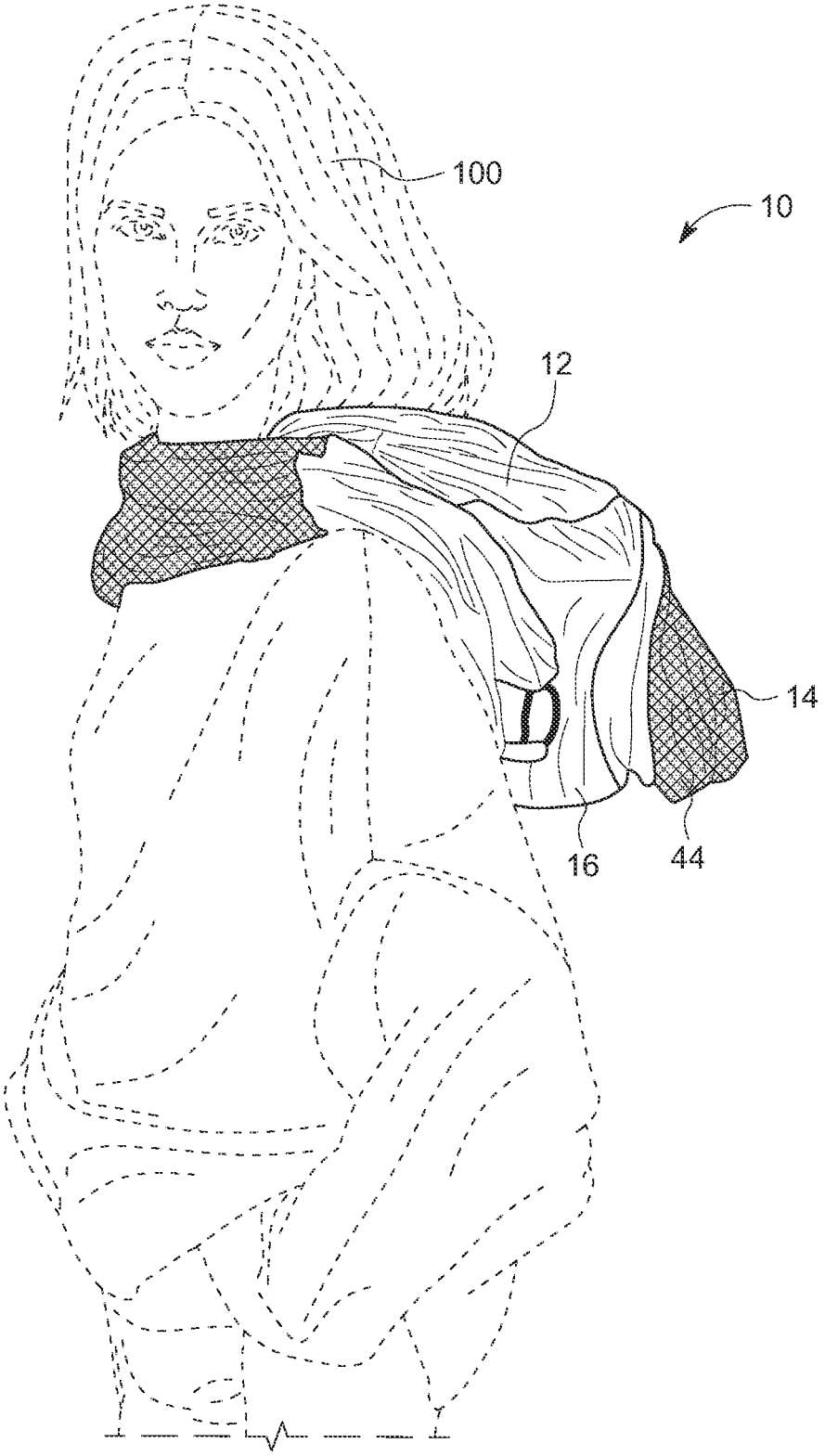
FIG. 5 is a perspective view of the garment being worn around the neck of a user but with both the tubular body and the hood undeployed according to the embodiment of the present invention.
Figure 6:
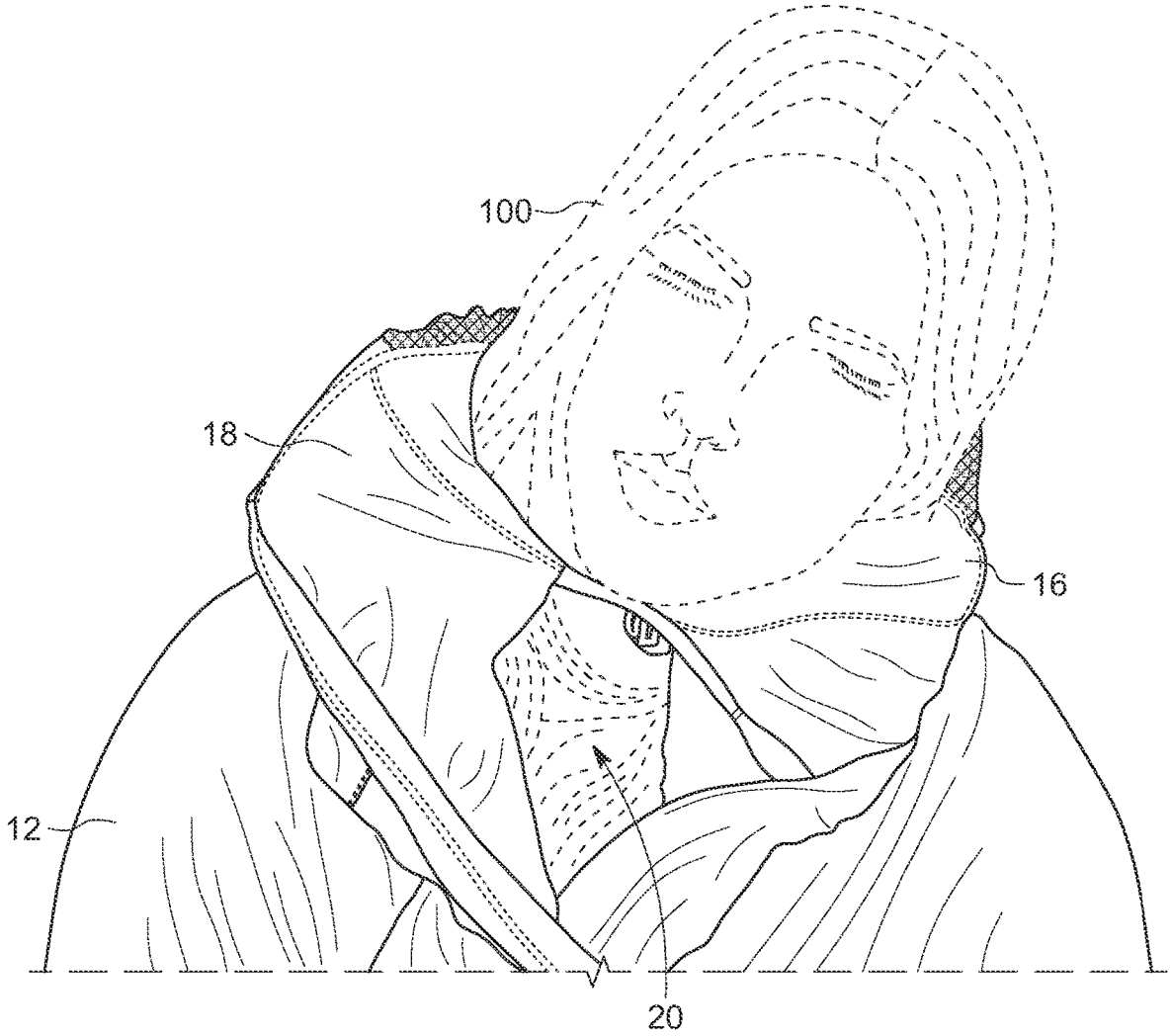
FIG. 6 is a perspective view of a user wearing the garment in with the hood down and resting her head to the side against a travel pillow member according to the embodiment of the present invention.

As best seen in FIGS. 1 & 2, the upper neck opening 20 of the tubular body 12 is generally V-shaped extending over the front of the garment. The large neck opening provides for the attachment of the oversized hood 14 thereto, but also facilitates the wearing of the garment when not in use as is illustrated in FIG. 5 wherein the pillow members 16 & 18 and portions of the garment proximate the pillow members draped behind or to the side of the wearer. In this configuration, the wearer has full unhindered use of his/her neck and head without having to remove the garment.

Figure 12:
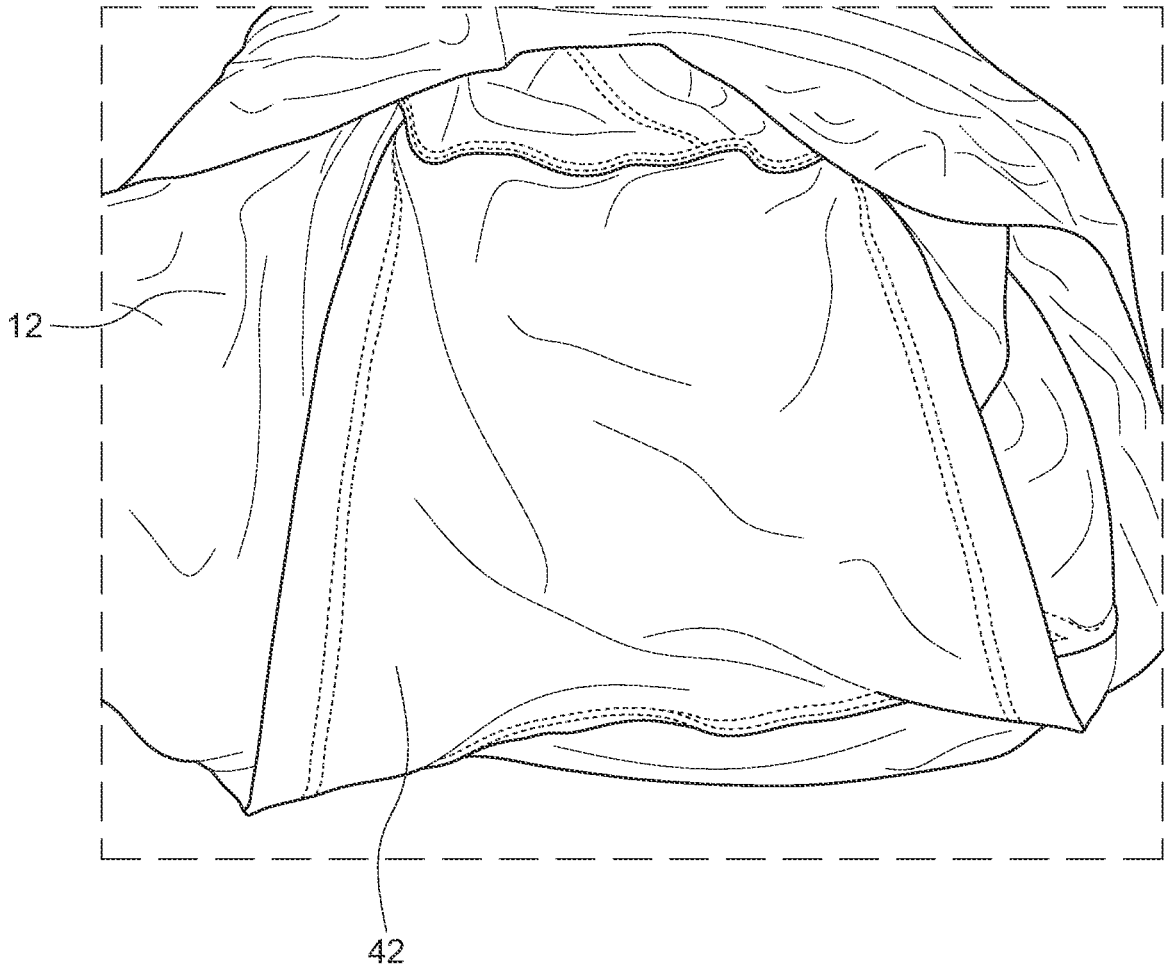
FIG. 12 is a close-up view of the tubular body turned inside out showing the internal kangaroo pocket according to the embodiment of the present invention.

FIG. 12 shows the front side of the tubular body 12 turned inside out illustrating an internal kangaroo pocket 42 that is provided in at least some embodiments of the garment. The pocket can serve several purposes including providing a means to support the forearms of a wearer when the arms are crossed, and providing a means to store various articles therein.

The oversized hood 14 is configured such that it can be draped over some or most of a wearer's face covering his/her eyes and filtering out a significant amount of light and glare. As shown in FIG. 2, the wearer's eyes and nose are covered but given its oversize nature, it can also be pulled forward to cover the substantial entirety of the wearer's face.

Figure 11:
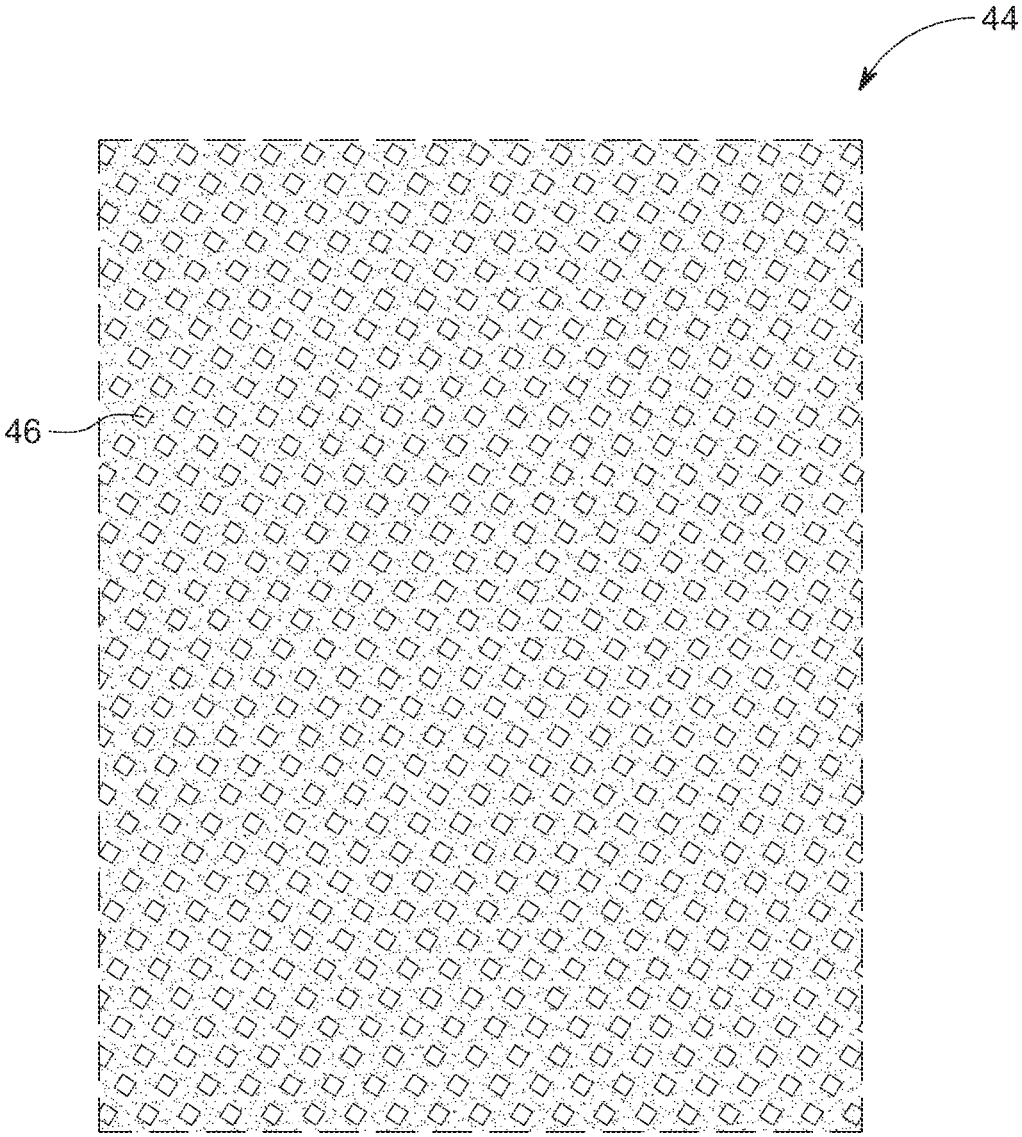
FIG. 11 is a close-up view of the mesh fabric used in the hood according to the embodiment of the present invention.

In the illustrated embodiment, the hood 14 is comprised of a perforated fabric 44 of which a section is shown in FIG. 11 having a plurality of openings 46 woven therein and distributed over the fabric in a regular pattern. The perforated fabric permits the wearer to see out of the hood while preventing others from seeing in. In variations, a more opaque fabric can be used to more completely block out light while also inhibiting the wearer of seeing through the fabric.

Figure 7:
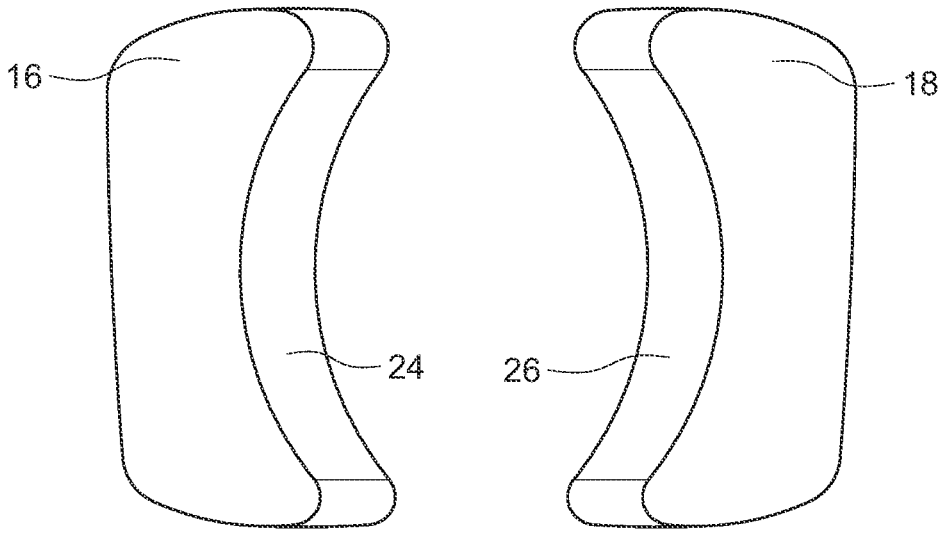
FIG. 7 is a perspective view of the right and left foam travel pillow members according to the embodiment of the present invention.

FIG. 7 is an illustration of the right and left foam pillow members 16 & 18. They are typically comprised of a polyurethane open cell foam having a density of between 1.5 and 30 pounds per cubic foot. They are generally rectangular, about 8" long, about 4" thick and about 2.5" wide, but, as shown, the top side 24 & 26 of each pillow member is curved to better cradle the neck. Other suitable shapes, configurations and materials are contemplated. Each pillow member is covered in essentially the same fabric that comprises the tubular body 12 to provide a soft touch.

Figure 8:
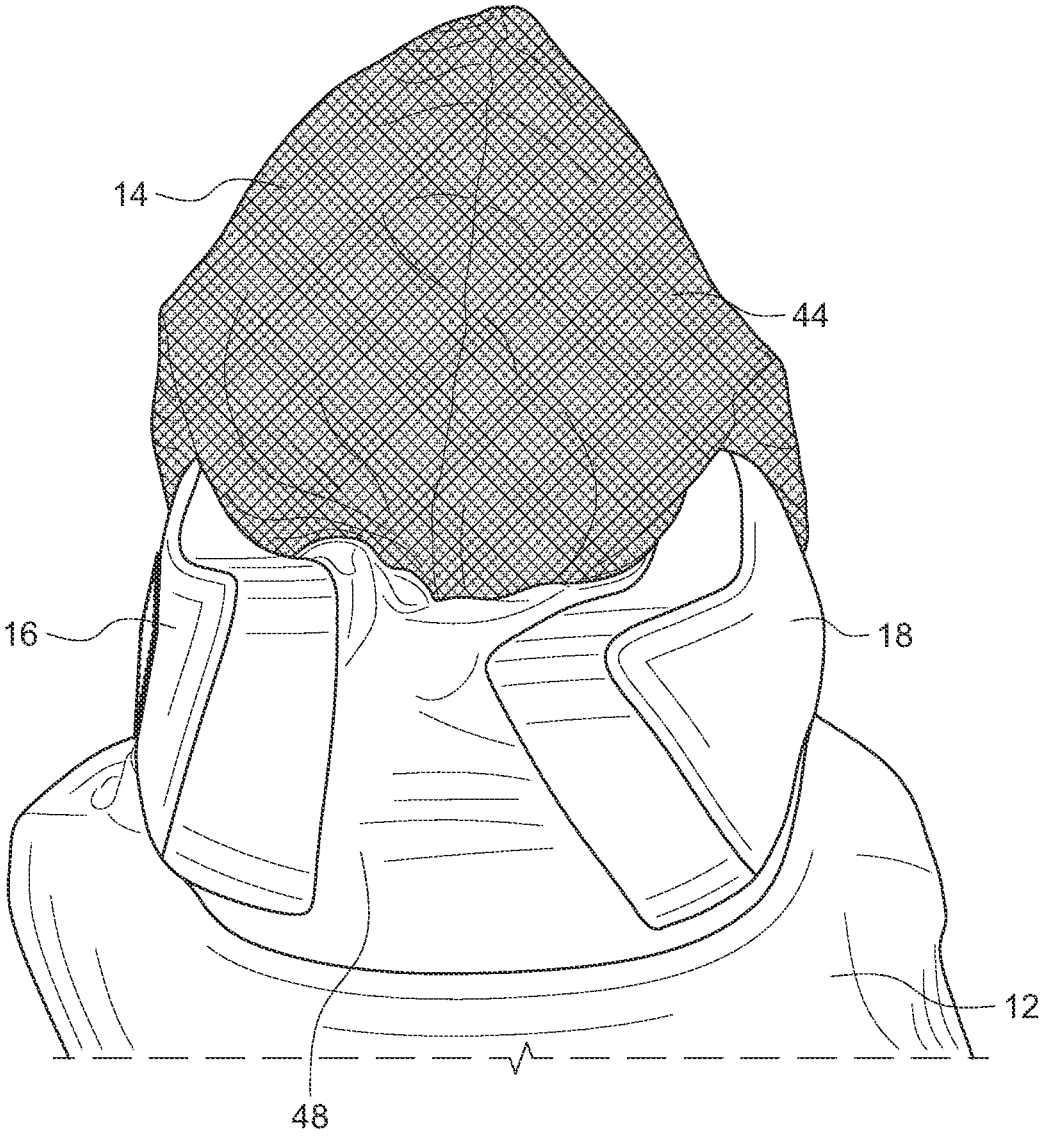
FIG. 8 is a close-up of the back of the garment showing the back ends of the travel pillow members encased in fabric and separated by a section of fabric according to the embodiment of the present invention.

Notably, the left and right pillow members 16 & 18 are separate and distinct from each other. They are separated from each other on the backside of the garment by a 2-4 inch wide connecting strip 48 of elastic fabric as is best shown in FIG. 8. This permits a wearer to lean his or her head back against a seatback without the back section of a typical one piece neck pillow pushing against the back of the neck. The connecting strip also acts to prevent the pillow member as it is being leaned upon from sliding away from or out from under a wearer's neck.

Figure 9:
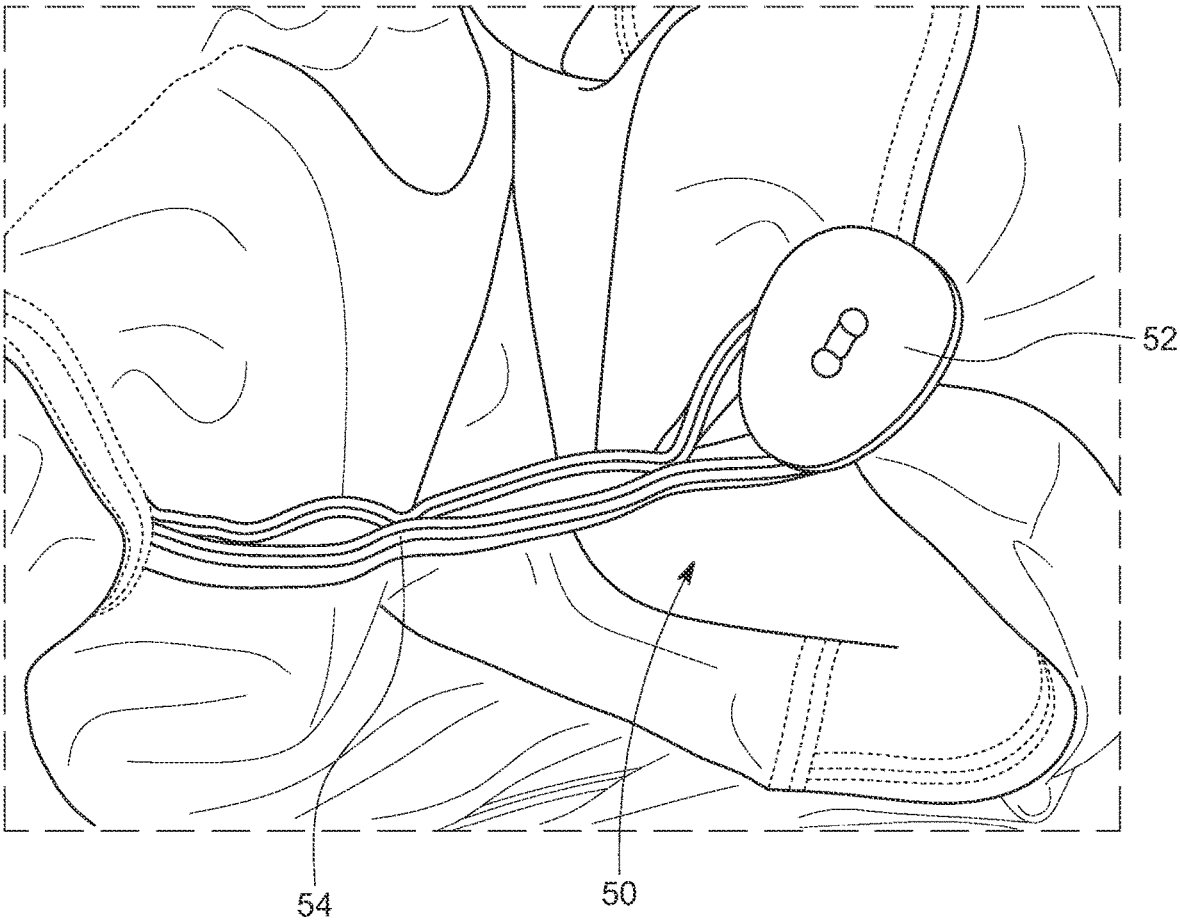
FIG. 9 is a close-up view of the adjustable strap assembly for adjusting the spacing of the travel pillow sections at front ends thereof according to the embodiment of the present invention.

As can be seen in FIG. 1 and in close-up FIG. 9, an adjustable strap assembly 50 is provided on the front side of the pillow members 16 & 18 to permit a wearer to adjust the front side spacing. As illustrated the strap assembly comprises an enlarged button 52 sewn to the fabric outside of the front of the left pillow member and a flexible elongated strap 54 segmented into three loops a long its length that is attached to the fabric outside of the front of the right pillow member. By securing one of the three loops over the button the distance between the fronts of the pillow members can be adjusted as desired by the wearer. As can be appreciated, different strap assemblies can be used in place of the assembly illustrated herein including hook and loop straps and adjustable buckle strap assemblies.

Methods of Using Embodiments of the Hoodie

Embodiments of the present invention can be used in place of one or more of a travel pillow, an eye mask, and a blanket during travel and particularly air travel. The garment further provides support for a wearer's arms especially when he/she is unable to utilize an arm rest presumably because the arm rest(s) is in use by other passengers.

A wearer first places his/her head through the torso opening and the neck opening so the garment is largely situated about the wearer's head. The wearer can leave the garment in this position if he/she desires to use one or both of the neck pillows and the hood. If so, the wearer would position the garment and so that the neck pillows are positioned respectively on the left and right sides of his/her neck, and optionally adjust the pillow adjustment strap assembly to snug the pillows against his/her neck by changing the spacing between the fronts of the neck pillow members.

Typically while seated, such as in an airline seat, the wearer may cant his/her head against the curved top surface of one of the pillow members. Prior to canting his/her head the wearer may optionally pull the hood over his/her head, and eyes. Alternatively, the wearer may leave the pillow loose not securing the pillow adjustment strap assembly and simply use the hood to buffer the light in the aircraft's cabin.

Typically, however, once the garment is positioned over the wearer's head, he/she pulls the tubular body over his/her upper body with his/her arms located within the sleeveless tubular body. The wearer then crosses his/her arms and places his/her left and right elbows in the respective left and right elbow pockets while crossing his/her forearms within tubular body. Optionally, the wearer may place his/her arms through the internal kangaroo pocket for additional support. As can be appreciated the garment can be used to support the wearer's arms whether or not the neck pillow members are being used and/or the oversized hood is deployed over the wearer's head and face.

I claim:

1. A garment for a wearer comprising a tubular body having a bottom torso opening and an opposing upper neck opening, the tubular body comprising opposing left and right elbow support pockets, wherein the left and right elbow support pockets are configured on opposing sides of the tubular body and accessible inside the tubular body, the right elbow support pocket is configured to provide cradling support for a right elbow of a right arm of a wearer when the right arm is folded in front of a torso of the wearer within the tubular body, and the left elbow support pocket is configured to provide cradling support for a left elbow of a left arm of a wearer when the left arm is folded in front of the torso of the wearer within the tubular body;

a hood comprised of fabric, the hood being attached to the tubular body at the neck opening; and at least one pillow member supported by the tubular body below and proximate the neck opening such that at least a portion of the at least one pillow member is located proximate opposing sides of the neck opening such that the at least one pillow member supports a head of the wearer.

2. The garment of claim 1, wherein each of the plurality of fabric sections is comprised of elastic fabric.

3. The garment of claim 1, wherein the tubular body does not include sleeves.

4. The garment of claim 1, wherein the front side of the tubular body further includes an internal kangaroo pocket.

5. The garment of claim 1, wherein the hood is configured to cover eyes of the wearer when the garment is worn.

6. The garment of claim 5, wherein the hood is at least partially comprised of a mesh fabric.

7. The garment of claim 1, wherein the at least one pillow member comprises left and right pillow members.

8. The garment of claim 7, wherein the left and right pillow members are each about 8" long, about 4" thick and about 2.5" wide.

9. The garment of claim 7, wherein a section of fabric on the back side of the garment separates the left and right pillow members.

10. The garment of claim 7 wherein each of the left and right pillow members comprises at least one foam body having a density between 1.5 and 30 pounds per cubic foot.

11. The garment of claim 7, wherein a strap assembly is provided proximate a front side of the left and right pillow members and proximate an intersection of the hood and the neck opening of the tubular body, the strap assembly permitting a wearer to adjust the distance between the front sides of the left and right pillow members when the garment is being worn.

12. The garment of claim 7, wherein the strap assembly comprises (i) a button attached to tubular body proximate the intersection and the front side of one of the right and left pillow members, (ii) a woven string comprising a plurality of loops along a length of the string attached to tubular body proximate the intersection and the front side of the other of the right and left pillow members, wherein the button may be received in any one of the plurality of loops to secure the strap assembly closed.

13. A method of at least partly covering a wearer, the method comprising:

providing a tubular body having a bottom torso opening and an opposing upper neck opening, the tubular body comprising opposing left and right elbow support pockets, the left and right elbow support pockets being configured on opposing sides of the tubular body and accessible inside the tubular body, the right elbow support pocket being configured to provide cradling support for a right elbow of a right arm of a wearer when the right arm is folded in front of a torso of the wearer within the tubular body, and the left elbow support pocket being configured to provide cradling support for a left elbow of a left arm of a wearer when the left arm is folded in front of the torso of the wearer within the tubular body;

supporting at least one pillow member on the tubular body below and proximate the neck opening;

supporting a hood on the tubular body proximate the neck opening configuring the torso opening and the neck opening such that a head of a wearer may be placed into the torso opening and out of the neck opening;

configuring the tubular body such that the tubular body may be pulled down around at least the upper part of a body of the wearer;

configuring the left and right elbow pockets such that, with left and right arms of the wearer within the tubular body, the left and right elbows of the wearer may be arranged in the respective left and right elbow support pockets; and arranging the at least one pillow member to support the head of the wearer; and arranging the hood over at least a portion of the head of the wearer.

14. The method of claim 13, further comprising placing the hood over a head of the wearer such that the hood at least partly covers eyes of the wearer.

15. The method of claim 13, further comprising the steps of supporting left and right pillow members on the tubular body adjacent to the neck opening of the tubular body; and adjusting a strap assembly to alter spacing between the fronts of the left and right pillow members.

16. The method of claim 13, further comprising the steps of:

supporting left and right pillow members on the tubular body adjacent to the neck opening of the tubular body;

supporting a strap assembly proximate an intersection of the hood and the neck opening of the tubular body; and adjusting the strap assembly to alter a spacing between the front sides of the left and right pillow members.

17. A garment for a wearer comprising a tubular body having a bottom torso opening and an opposing upper neck opening but no sleeves, the tubular body defining opposing left and right elbow support pockets, where the left and right elbow support pockets are configured on opposing sides of the tubular body and accessible inside the tubular body, the right elbow support pocket is configured to provide cradling support for a right elbow of a right arm of the wearer when the right arm is folded in front of a torso of the wearer within the tubular body, and the left elbow support pocket is configured to provide cradling support for a left elbow of a left arm of the wearer when the left arm is folded in front of the torso of the wearer within the tubular body;

an oversized hood comprised of fabric, the hood being attached to the tubular body at the neck opening and being configured to cover eyes of a wearer when the garment is worn; and a pair of left and right foam pillow members located proximate the neck opening wherein the left pillow and the right pillow members are located proximate opposing sides of the neck opening and each of the left and right pillow members defines a curved top side.

18. The garment of claim 17 wherein the hood is at least partially comprised of a mesh fabric configured to block at least 50% of exterior light but permitting a wearer to see therethrough when the hood is worn over the eyes.

19. The garment of claim 17, further comprising a strap assembly supported by the tubular member proximate to the left and right pillow members and to an intersection of the hood and the neck opening of the tubular body, the strap assembly permitting a wearer to adjust the distance between the front sides of the left and right pillow members when the garment is being worn.

20. The garment of claim 17, wherein the left and right pillow members are about 8" long, about 4" thick, and about 2.5" wide.

* * * * *